United States Patent [19]

Miyaji

[11] Patent Number: 4,845,523

[45] Date of Patent: Jul. 4, 1989

[54] A DEVELOPING DEVICE FOR AN ELECTROPHOTOGRAPHIC COPYING MACHINE

[75] Inventor: Takashi Miyaji, Yamatokoriyama, Japan

[73] Assignee: Sharp Kabushiki Kaisha, Osaka, Japan

[21] Appl. No.: 96,819

[22] Filed: Sep. 10, 1987

Related U.S. Application Data

[63] Continuation of Ser. No. 774,453, Sep. 10, 1985, abandoned.

[30] Foreign Application Priority Data

Sep. 11, 1984 [JP] Japan ..... 59-191238
Sep. 13, 1984 [JP] Japan ..... 59-193782

[51] Int. Cl.[4] ..... G03G 15/06
[52] U.S. Cl. ..... 355/211; 355/260
[58] Field of Search ..... 355/3 R, 3 DR, 3 DD, 355/5; 118/653; 222/DIG. 1

[56] References Cited

U.S. PATENT DOCUMENTS 3,764,208 10/1973 Takahashi et al. ..... 355/3 DD
4,132,476 1/1979 Wetzel ..... 355/3 DD
4,237,943 12/1980 Ermel et al. ..... 222/DIG. 1 X
4,271,784 6/1981 Ishimoto et al. ..... 355/3 DD X
4,530,588 7/1985 Kimura et al. ..... 355/3 DR
4,542,976 9/1985 Kasamura ..... 355/3 DD X
4,563,074 1/1986 Tsutsui ..... 355/30 RX

FOREIGN PATENT DOCUMENTS 57-86875 5/1982 Japan ..... 355/3 DD
57-94764 6/1982 Japan ..... 355/3 DD

*Primary Examiner*—Arthur T. Grimley
*Assistant Examiner*—J. Pendegrass
*Attorney, Agent, or Firm*—Birch, Stewart, Kolasch & Birch

[57] ABSTRACT

An electrophotographic copying machine including a unit consisting of a photoreceptor and a developing device. The unit can be pulled out of or into the copying machine. The developing device has a developer outlet provided at its bottom, and first and second grooves. A developer funnel can be coupled to the first groove to receive the old developer from the developing device. The first groove is also provided for guiding a lid closing the developer outlet. The funnel can also be coupled to the second groove to supply the new developer. In a specific form, the developing device can be shifted from a position close to the photoreceptor to a position separate from the same. The developing device can also be moved with a quadric link chain pivotally supported on the frame of the unit of the photoreceptor and the developing device. Positioning members are provided in the frame for positioning the developing device in both positions.

17 Claims, 7 Drawing Sheets

A DEVELOPING DEVICE FOR AN ELECTROPHOTOGRAPHIC COPYING MACHINE

This application is a continuation of applictation Ser. No. 774,453 filed on Sept. 10, 1985, now abandoned.

BACKGROUND OF THE INVENTION

The present invention relates to an electrophotographic copying machine and, more particularly, to the structure of a developing device an electrophotographic copying machine.

In a conventional electrophotographic copying machine, maintenance tends to be complicated because of the composite structure of the copying machine and because of the intelligent features of the copying machine. A photoreceptor and its related devices such as a developing device can be united for the sake of maintenance. However, the recovery of old developing agent from the developing device might present trouble. Further, since the developing device is positioned adjacent to the photoreceptor, changing the photoreceptor should be followed by positioning the developing device far from the photoreceptor to make it easy to change the photoreceptor. Nevertheless, the developing device should be accurately positioned in relation with the photoreceptor, so that conventionally, the developing device is fixed with screws. Although the photoreceptor and its related devices are united, the loosening of the screws delays the maintenance procedure.

SUMMARY OF THE INVENTION

Accordingly, it is an object of the present invention to provide an improved electrophotographic copying machine for ensuring easy maintenance including the recovery of old developing agent.

It is another object of the present invention to provide an improved electrophotographic copying machine for ensuring easy maintenance in a copying machine of the type including photoreceptor and a developing device unit in which the developing unit is accurately positioned with respect to the photoreceptor.

Briefly described, in accordance with the present invention, an electrophotographic copying machine is provided including a photoreceptor and a developing unit. The developing unit can be pulled out of or into the copying machine. The developing unit has a developer output opening provided at its bottom, and first and second grooves. A developer funnel is provided for receiving the developer from the developing unit through the developer outlet. The second groove means is coupled to the opening of the funnel means that receives the developer. The first groove is provided for guiding a lid closing the developer outlet opening.

In a second preferred embodiment of the present invention, the developing unit can be shifted to a position close to the photoreceptor and to a position separate from the same. The developing unit is moved with a quadratic link chain pivotally supported on a frame of the unit. Means are provided in the frame for positioning the developing unit in the close position and the separating position thereof.

BRIEF DESCRIPTION OF THE DRAWINGS

The present invention will become more fully understood from the detailed descriptiion given hereinbelow and the accompanying drawings which are given by way of illustration only, and thus are not limitative of the present invention and wherein.

DESCRIPTION OF THE INVENTION

Figure 1:
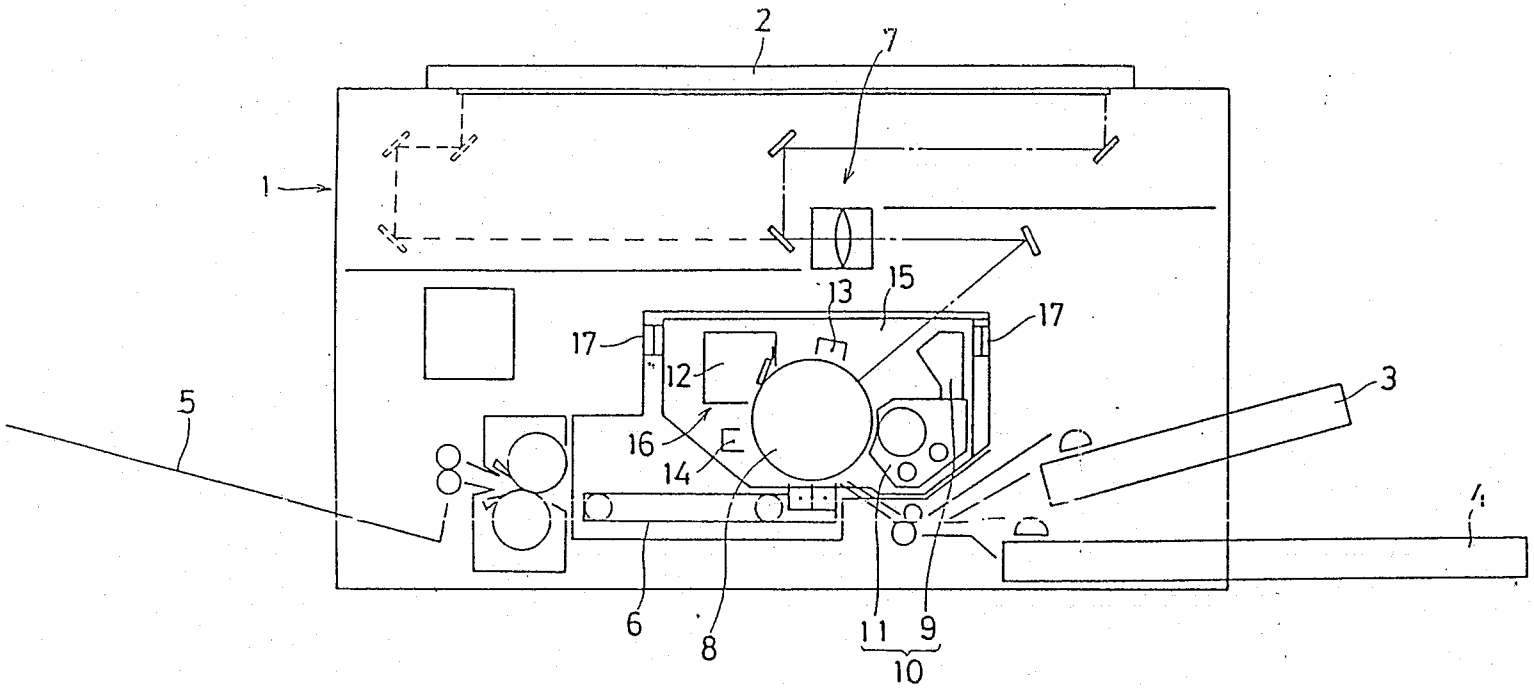
FIG. 1 is a side view of an electrophotographic copying machine according to a first preferred embodiment of the present invention.

FIG. 1 shows a side view of an electrophotographic copying machine according to a first preferred embodiment of the present invention.

Referring to FIG. 1, on the upper body of a copying machine 1, a document table 2 is disposed on which a copy document is mounted to be copied. A light source is provided for emitting light toward the copy document to form an electrostatic latent image on a photoreceptor by gathering the reflected light from the document via a lens 7. At the right of the body, copy paper cassettes 3 and 4 are attached to supply a copy paper while at the left side, an exhaust tray 5 is attached to receive a copied copy paper. Across from the copy paper cassettes 3 and 4, and the exhaust tray 5, a paper feeding path 6 is provided.

At the inner portions of the copying machine 1, there are provided a light exposure device including the lens 7, a photorecptor 8, a developing device 10 including developer box 9 and a developing tank 11, a cleaner 12, a charger 13, and a charge removal device 14.

According to the present invention, the photoreceptor 8, the developing device 10, the cleaner 12, the charger 13, and the charge removal device 14 are united with a unit frame 15 form a unit 16. The unit 16 can be pulled out of or into the copying machine 1 along a pair of slides 17 disposed between the frame 15 and the body of the copying machine 1.

Figure 2:
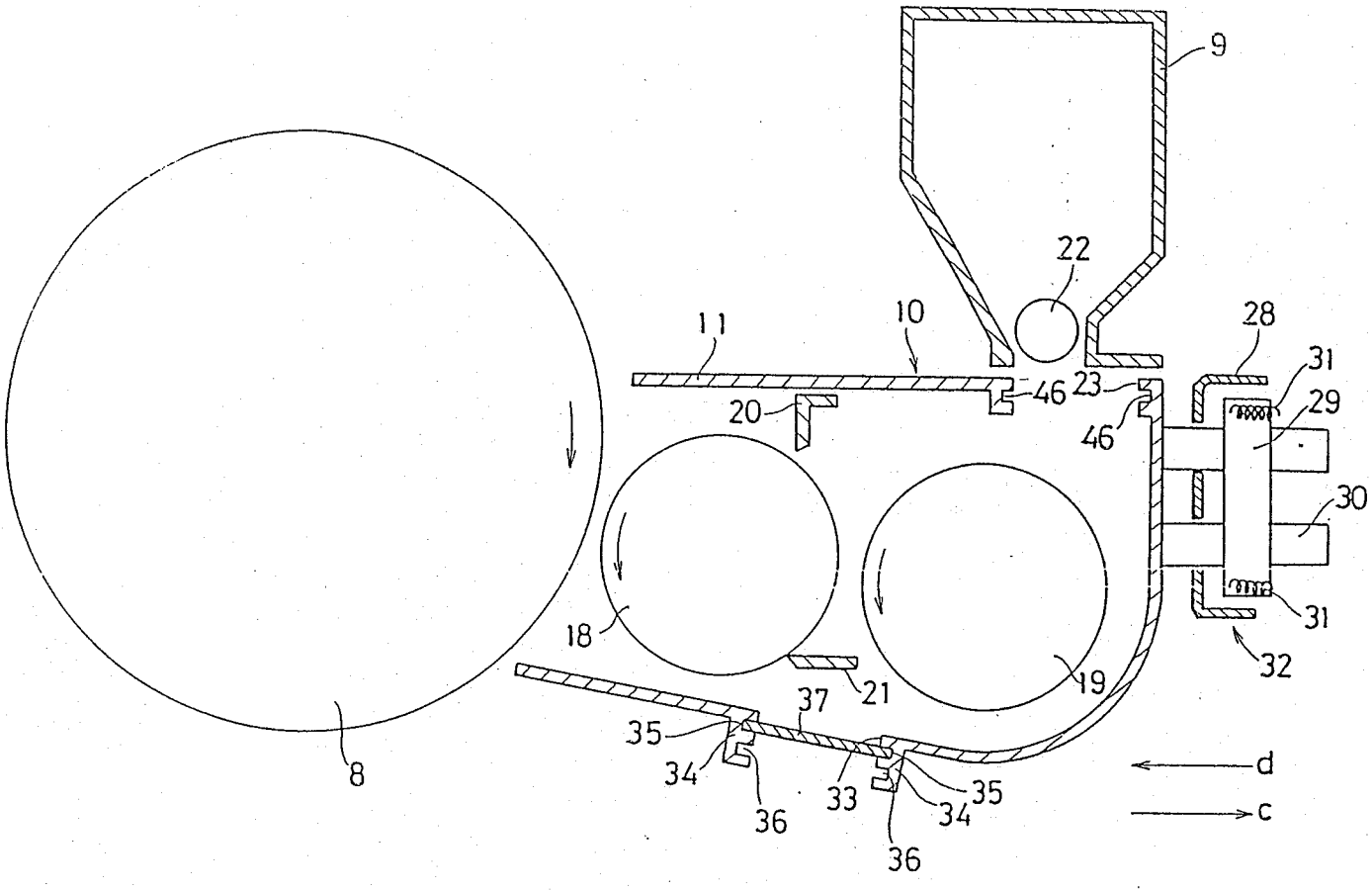
FIG. 2 shows a sectional view of a developing tank in the copying machine of FIG. 1.
Figure 3:
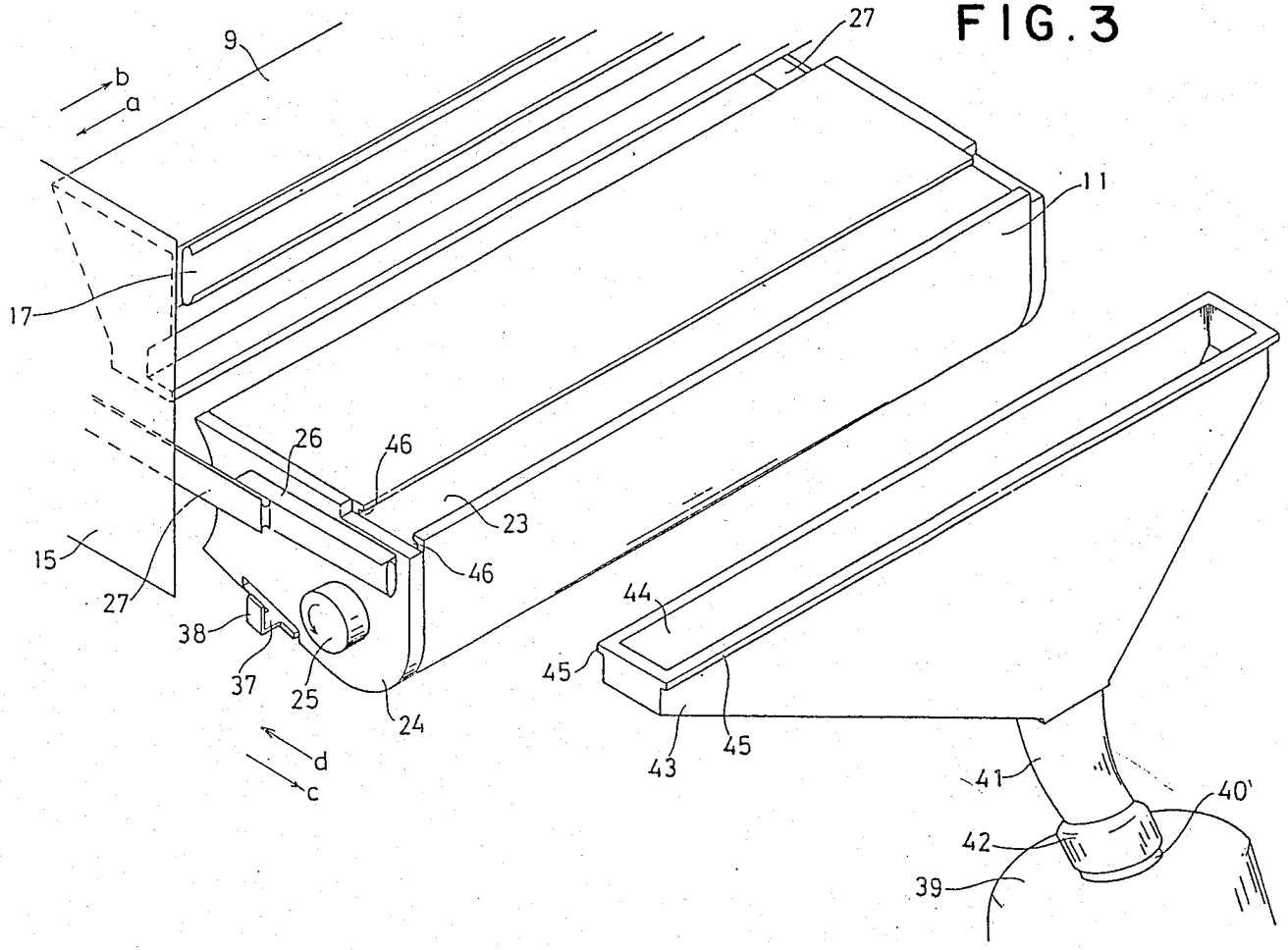
FIG. 3 is a perspective view of the developing tank of FIG. 2.

FIGS. 2 and 3 show the developing tank 11 within the unit 16.

With reference to FIG. 2, in the developing tank 11, there are provided a magnet roller 18, a stir roller 19, a doctor blade 20, and a scraper 21. The doctor blade 20 is provided for controlling the adherence amount of the developer around the magnet roller 18. At the upper portion of the developing tank 11, an opening is provided corresponding to a developer dropping shaft 22 within the developer box 9. The developer box 9 is provided for forwarding the developer into the developing tank 11 while the copying machine 1 is operated.

With reference to FIG. 3, at one side 24 of the developing tank 11, a knob 25 is provided for rotating the rollers 18 and 19. A pair of guides 26 and bars 27 are provided for enabling the developing tank 11 to slidably reciprocate in the directions of arrows c and d perpendicular to the directions of arrows a and b, the direction of a and b being such that the unit 16 can be pulled in or out of the copying machine 1. Normally, the developing tank 11 is elastically stressed in the direction d by a pressure mechanism 32 including a frame coupling plate 28, a pressure shaft 29, a pressure roller 30, and two pressure springs 31.

In FIG. 2, on the bottom of the developing tank 11, an elongated opening 33 is formed for exhausing the old developer therethrough from the developing tank 11. Side walls 34 of the opening 33 are formed on the brim of and projecting below the bottom of the tank 11. Within the inner portion of each of the walls 34, a lower groove 36 and an upper groove 35 are formed. A flat lid 37 can be inserted in and removed from the lower groove 36 to close the opening 33. As shown in FIG. 3, a pulling-out handle 38 is attached to the lid 37.

Further, as shown in FIG. 3, for maintenance, a developer bottle 39 is provided for receiving the old developer. To an inlet 40 of the bottle 39, an end of an elastic pipe 41 is jointed with a joint 42. To the other end of the pipe 41, a funnel 43 is coupled. The funnel 43 is provided with a large elongated opening 44. Along both elongated sides of the opening 44, each projection 45 is provided which can be inserted in the upper groove 35 at the developer exhaust opening 33. For supplying the developer, a slide groove 46 is provided at the brim of a developer supply opening 23 on the top side of the developing tank 11. The developer supply opening 23 can be used to supply developer from the bottle 39, in place of being coupled to the developer box 9, when the projection 45 of the funnel 43 is inserted in the slide groove 46 of the developer supply opening 23.

The operation in the first preferred embodiment of the present invention will be described.

Figure 4:
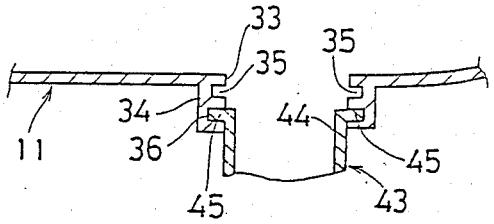
FIG. 4 is a perspective view of a connection portion between the developing device and a funnel according to the present invention.

To recover the old developer from the developing tank 11, the unit 16 containing the photoreceptor 8 and the developing device 10 is pulled out of the copying machine 1 by pulling it in the direction a of FIG. 3. Next, the pressure of the pressure mechanism 32 loosens. Finally, the unit 16 is completely pulled out of the copying machine 1 by pulling it in this direction. The developing tank 11 is shifted in the direction c of FIG. 3, so that it is far from the side of the photorecptor 8 and the developer box 9, which condition is shown in FIG. 3. The projection 45 of the funnel 43 to which the bottle 39 is coupled through the pipe 41 is inserted in the slide groove 36 of the opening 33 in the developing tank 11 as shown in FIG. 4.

Under the circumstances, the lid 37 is pulled out of the slide groove 35, so that the developer can be transferred from the developing tank 11 to the bottle 39 through the funnel 43.

The developer adhered to the magnet roller 18 is scraped by the scraper 21 by rotating knob 25. Thus, the total developer can be gathered from the developing tank 11 to the bottle 39. Finally, after the lid 37 is slided to close the opening 33 of the tank 11, the funnel 43 is separated from the tank 11 to end the developer recovery procedure. Meanwhile, since the opening 44 of the funnel 43 is coupled to the opening 33 of the developing tank 11, an easy, rapid procedure can be expected surrounding dirt.

Further, since the slide groove 46 is formed at the developer supply opening 23 on the top side of the tank 11, it is easy to supply new developer. In such a case, the bottle 39 is prepared for containing the new developer. The projection 45 of the funnel 43 is inserted in the slide groove of the opening 23 in the tank 11, so that the bottle 39 is reversed to transfer the new developer from the bottle 39 to the developer tank 11. This procedure is superior since it prevents any dirt from intering the developing tank 11.

After the developer has been recovered from the developing tank 11 to the bottle 39, the tank 11 is pushed in the direction d of FIG. 3, so as to install the tank 11 within the unit frame 15. The rotation of the knob 25 is also prevented. The unit 16 and the unit frame 15 are stressed in the direction b, so that the pressure mechanism 32 with the stress permits the tank 11 to be positioned at an appropriate location within the copying machine 1.

Figure 5:
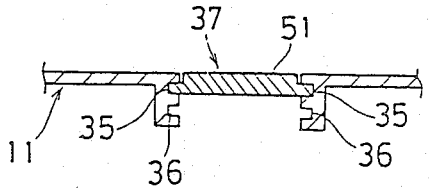
FIG. 5 is a sectional view of a lid for covering a developer exhaust opening, showing an example of the lid.

In the first preferred embodiment of the present invention, there is present some clearance between the inner plane of the lid 37 closing the developer exhaust opening 33 of the tank 11 and the bottom of this tank 11. Since this clearance is normally very small, the flowing of the recovering developer will not be stopped. However, as shown in FIG. 5, a flat projection face 51 can be disposed on the upper surface of the lid 37 to cancel any clearance.

Figure 6:
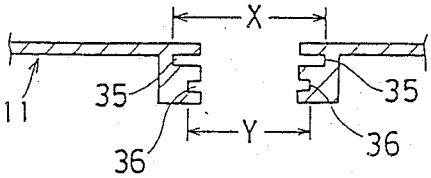
FIG. 6 is a sectional view of a slide groove, showing an example of the slide groove.

Further, preferably, the depth of the lower and the upper grooves 36 and 35 respectively, of the developer exhaust opening 33 can be spaced apart from each other to avoid mis-coupling due to confusion. Alternatively, as shown in FIG. 6, the width of each of the grooves 35 and 36 can differ from each other. The mis-coupling of the lid 37 into each of the grooves 35 and 36 can therefore be avoided.

It may be evident that the structure of the lid 37 should not be limited to a slide type as described above. It may be possible that the lid 37 can be attached with a hinge means.

As described above, in accordance with the first preferred embodiment of the present invention, the funnel opening is coupled to the developer exhaust opening of the developing tank 11 in the unit 16. The developer can be recovered from the developing device. Further, the developer supply funnel can be coupled to the developer supply opening of the developing tank 11. The recovery and the supplying of the developer can be easily conducted without exposure to dirt.

Figure 7:
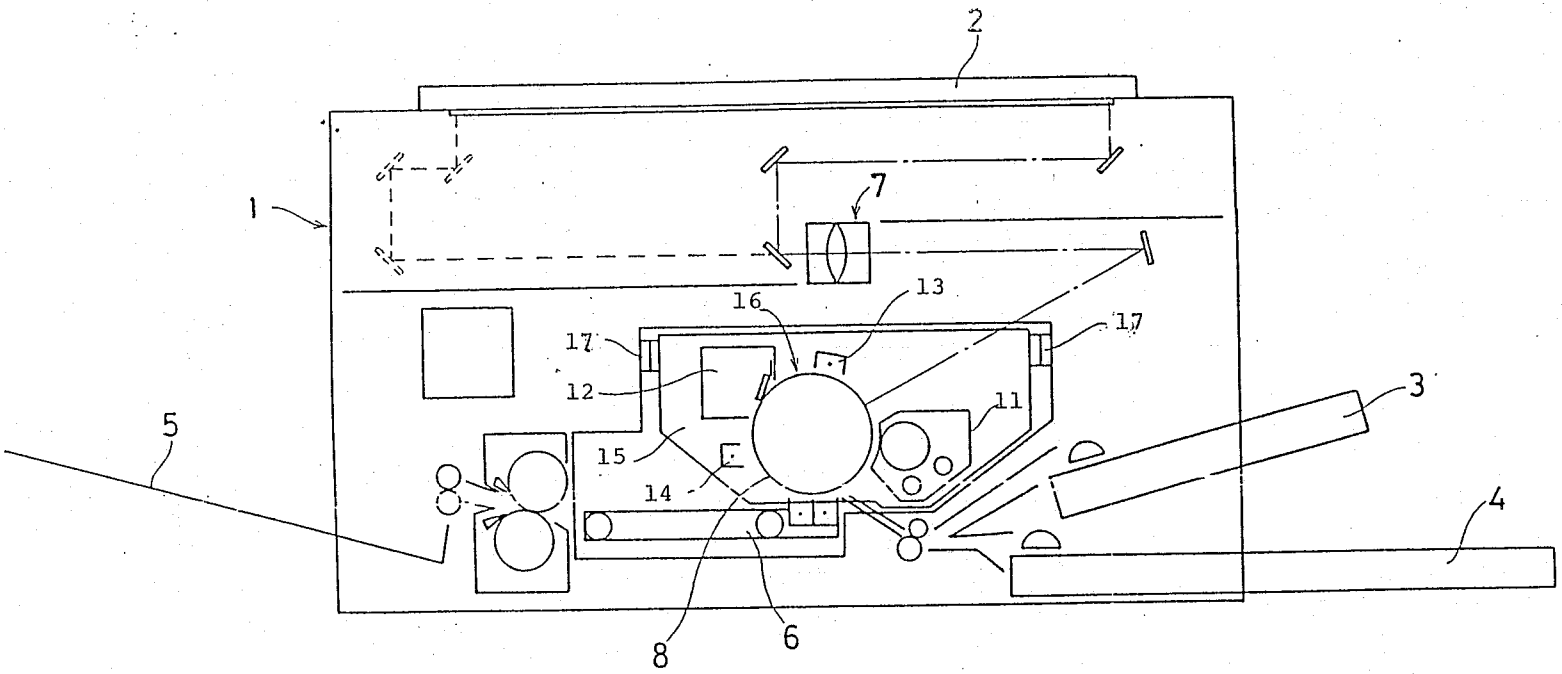
FIG. 7 is a side view of an electrophotographic copying machine in a second preferred embodiment of the present invention.

FIG. 7 is a side view of an electrophotographic copying machine according to a second preferred embodiment of the present invention. Like elements in FIG. 1 are indicated by like numerals in FIG. 7. In the second preferred embodiment, the structure of the developing device is improved, so that the developer box 9 of FIG. 1 is omitted from the illustration. In the second preferred embodiment, the developing tank 11 of FIG. 1 is treated as the developing device.

Figure 8:
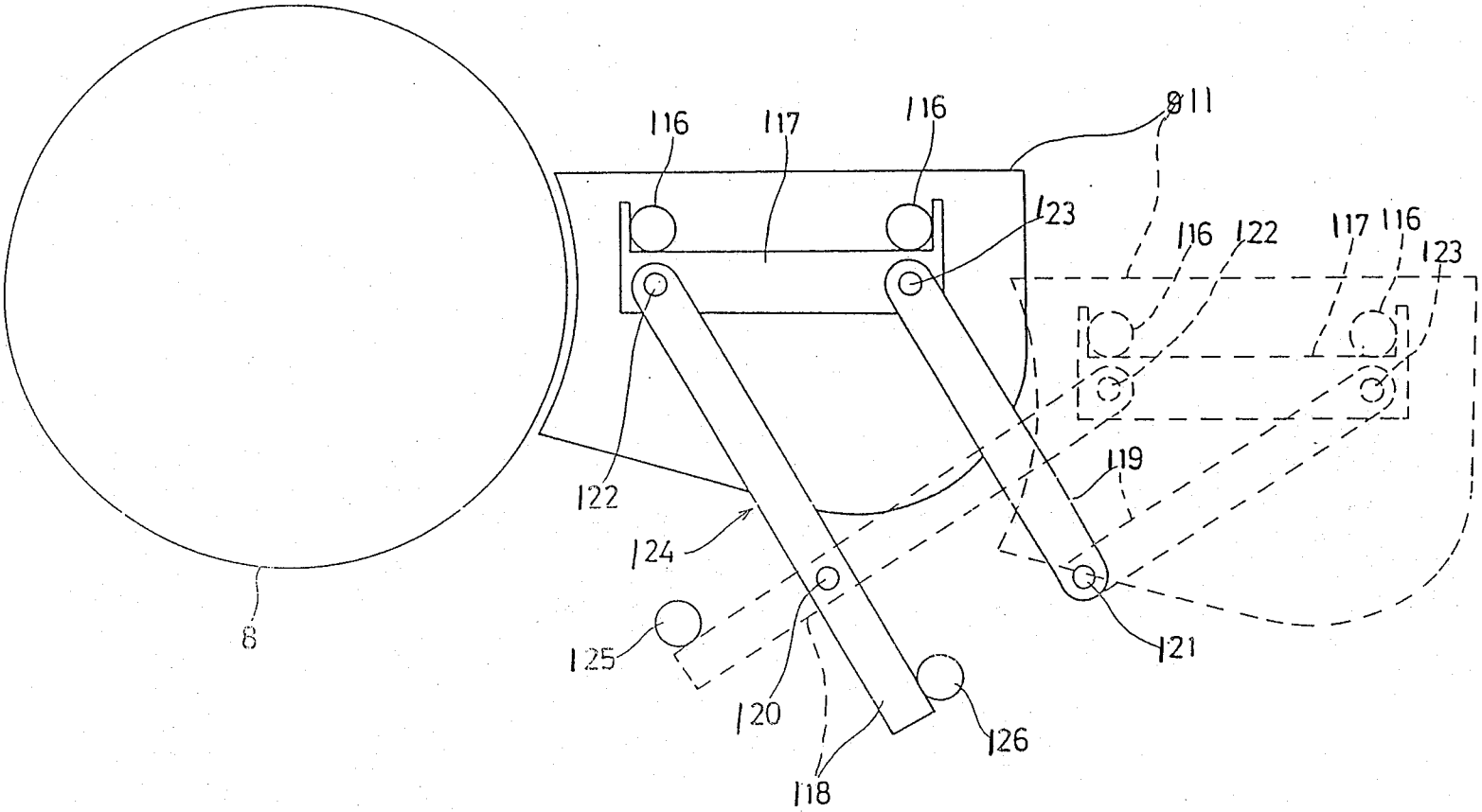
FIG. 8 is a side view of a portion of a unit including a photoreceptor and a developing device.
Figure 9:
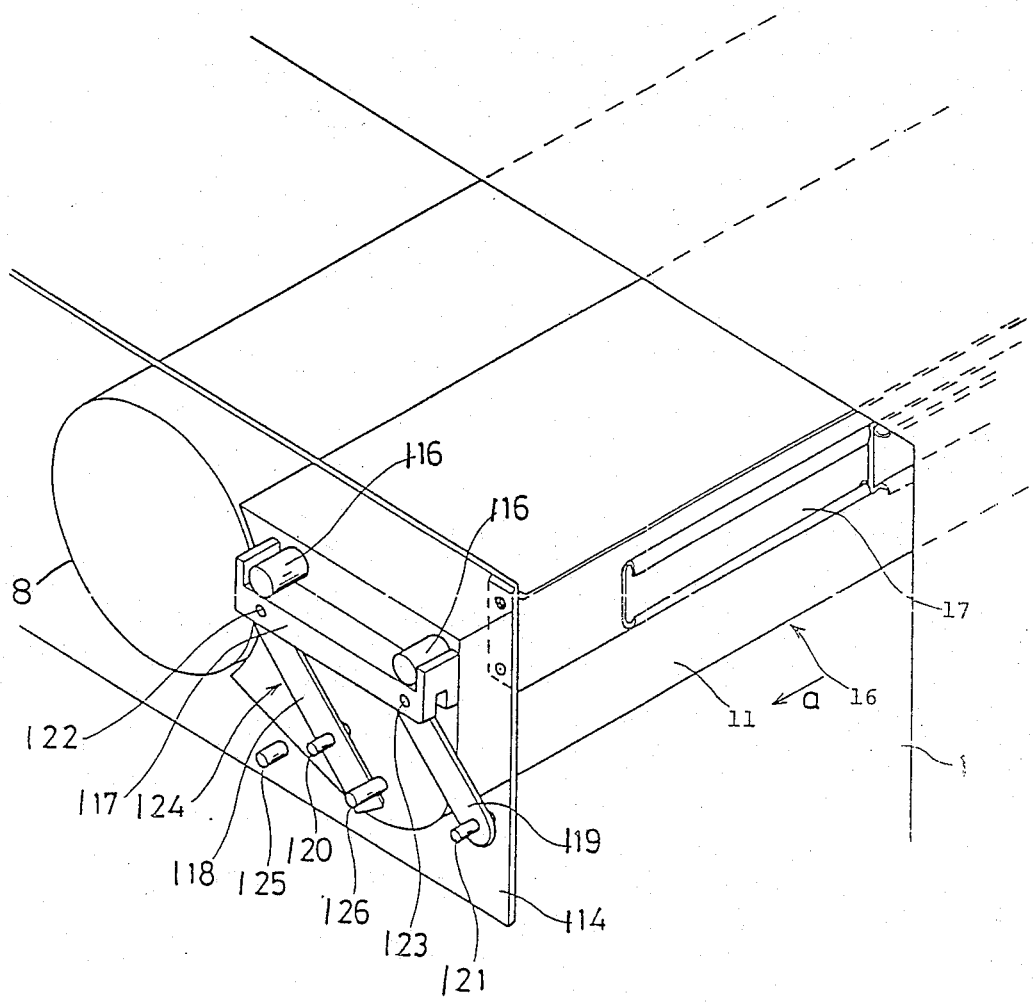
FIG. 9 is a perspective view of a portion of FIG. 8.

FIGS. 8 and 9 show the developing device 11 in the unit 16 of the present invention.

Referring to FIG. 8, the developing device 11 is provided to be able to move in connection with the photoreceptor 8 between the developing position (the close position) as indicated by the solid line of FIG. 8 and the separating position as indicated by the broken line of FIG. 8. The developing device 11 is supported on a supporting member 117 via a pair of bosses 116 projected normal to the separate direction. Between the supporting member 117 and the frame 15 of the unit 16, a pair of first and second parallel levers 118 and 119 are provided. The lower ends of the levers 118 and 119 are pivotally connected to a pair of shafts 120 and 121 projected from the unit frame 15. The upper ends of the levers 118 and 119 are pivotally connected to a pair of shafts 122 and 123 fixed to the supporting member 117. Thus, the first and the second levers 118 and 119, and the supporting member 117 form a quadric link chain 124 for changing the position of the developing device 11. The unit frame 15 is provided with a pair of positioning pins 125 and 126 corresponding to the close position and the separate position of the developing device 11 with respect to the photorecptor 8.

The operation of the second preferred embodiment of the present invention will be described.

To conduct maintenance such as replacing the old photoreceptor 8 with a new one, the unit 16 and the unit frame 15 are drawn out of the machine in the direction a of FIG. 9, the unit 13 can be shifted from the initial position in the copying machine 1 to the position where the movement of te developing device 11 cannot be disturbed.

Under the circumstances, the developing device 11 is moved rightward with the lifting upward of FIG. 8, so that the developing device 11 is shifted along the locus of the angular motion of the quadric link chain 124, from the close position indicated by the solid line to the separate position indicated by the broken line. Because the developing device 11 is only mounted on the supporting member 117 as part of the quadric link chain 124 via the bosses 116, it can be separated by being lifted upward. The developer can be recovered from the separated developing device 11. The developing device 11 can be separated from the photoreceptor 8 at once and the photoreceptor 8 can be easily replaced.

To recover the developing device 11 within the attachment position, it is shifted leftward while being lifted upward in FIG. 8. It is moved from the separate position of the broken line to the developing or close position of the solid line. The positioning pin 126 is used to accurately position the arrangement of the developing device 11. Because of the self-weight of the developing device 11, it is kept accurately positioned adjacent to the photoreceptor 8.

As described above, according to the second preferred embodiment of the present invention, the quadric link chain 124 is used to shift the developing device 11 between the position close to the photoreceptor 8 and the position separate from it. The positioning of the developing device 11 becomes accurate. Further, the developing device 11 can be separated from the photoreceptor 8 immediately so as to shorten the maintenance procedure.

While only certain embodiments of the present invention have been described, it will be apparent to those skilled in the art that various changes and modifications may be made therein without departing from the spirit and scope of the present invention as claimed.

What is claimed is:

1. An electrophotographic copying machine comprising:

a photoreceptor on which an electrostatic latent image is formed by receiving a light image from a copy document; and developing means for developing said electrostatic latent image with a developer;

said photoreceptor and said developing means being integrally united and being connected to a unit frame means, said unit frame means being provided with a first slide so that said unit frame means can be slidably pulled out of or introduced into said electrophotographic copying machine and a second slide so that said developing means can be slidably extended away from and pushed toward said photorecptor means in a direction perpendicular to a sliding direction of said first slide;

said developing means including an inlet opening for supplying new developer therethrough into said developing means, an outlet opening for exhausting said developer therethrough, first and second grooves provided adjacent to said outlet opening, and a lid member for closing said outlet opening, said lid member being slidably inserted into said first groove;

said inlet opening and said outlet opening being independently capable of coupling to funnel means for introducing and removing said developer from a developer container, respectively, said funnel means being slidably inserted into said second groove of said outlet opening.

2. A copying machine as in claim 1, wherein said lid member has an upper flat face that is flush with the surface of the bottom of said developing means when said lid member is in a closed position.

3. A copying machine as in claim 1, wherein a width of said first groove is different from a width of said second groove.

4. A copying machine as in claim 1, wherein said developing means is connected to a guide means that is in turn slidably connected to a bar means that is in turn connected to said unit fram means so as to allow said developing means to be slidably moved close to and separated from said photoreceptor means.

5. A copying machine as in claim 2, wherein said inlet opening is provided with an inlet groove so as to allow said funnel means to be slidably inserted into said inlet groove for coupling said funnel means to said inlet opening.

6. An electrophotographic copying machine comprising:

photoreceptor on which an electrostatic latent image is formed by receiving a light image from a copy document;

developing means for developing said electrostatic latent image with a developer;

said photoreceptor and said developing means being integrally united as a unit such that said unit can be pulled out of or inserted into the electrophotographic copying machine;

quadric link chain means provided on the frame of the unit for shifting said developing means between a developing position for developing and a separating position of not developing in connection with said photorecptor means; and position means provided on the frame of the unit for fixing said developing means at the developing position and the separating position.

7. The machine of claim 5, wherein said position means comprises a pair of pins.

8. An electrphotograhic copying machine comprising:

a photoreceptor on which an electrostatic latent image is formed by receiving a light image from a copy document; and developIng means for developing said electrostatic latent image with a developer;

said photoreceptor and said developing means being integrally united and connected to a unit frame means, said unit frame means being provided with a slide so that said unit frame means can be slidably pulled out of or introduced into said electrophotographic copying machine;

said developing means including an inlet opening for supplying new developer therethrough into said developer means, an outlet opening for exhausting said developer therethrough, first and second grooves provided adjacent to said outlet opening, and a lid member for closing said outlet opening, said lid member being slidably inserted into said first groove;

said inlet opening and said outlet opening being removably coupled to a funnel for introducing and removing said developer into and from a developer container, respectively, said funnel being slidably inserted into said second groove of said outlet opening.

9. An electrophotographic copying machine comprising:

a photoreceptor on which an electrostatic latent image is formed by receiving a light image from a copy document; and developing means for developing said electrostatic latent image with a developer;

said photorecptor and said developing means being integrally united and being connected to a unit frame, said unit frame being provided with a slide so that said unit frame can be slidably pulled out of or introduced into said electrophotographic copying machine;

said developing means including an outlet opening for exhausting said developer therethrough, first and second grooves provided adjacent to said outlet opening, and a lid member for closing said outlet opening, said lid member being slidably inserted into said first groove and having an upper flat face that is flush with the surface of the bottom of said developing means when said lid member is in a closed position;

said outlet opening being capable of coupling to a funnel for removing said developer into a developer container, said funnel being slidably inserted into said second groove.

10. A copy machine as in claim 9, further including an inlet opening in said developing means for supplying new developer therethrough into said developing means, said inlet opening being capable of being coupled to said funnel for introducing said new developer.

11. A copying machine as in claim 10, wherein said inlet opening is provided with an inlet groove so as to allow said funnel to be slidably inserted into said inlet groove for coupling said funnel to said inlet opening.

12. A copying machine as in claim 9, wherein a width of said first groove is different from a width of said second groove.

13. A copying machine as in claim 9, wherein said developing means is connected to guide means that is in turn slidably connected to a bar means that is in turn connected to said unit frame so as to allow said developimg means to be slidably moved close to and separated from said photoreceptor means.

14. An electrophotographic copying machine comprising:

a photoreceptor on which an electrostatic latent image is formed by receiving a light image from a copy document; and developing means for developing said electrostatic latent image with a developer;

said photoreceptor and said developing means being integrally united and being connected to a unit frame, said unit frame being provided with a slide so that said unit frame can be slidably pulled out of or introduced into said electrophotographic copying machine;

said developing means including an outlet opening for exhausting said developer therethrough, first and second grooves provided adjacent to said outlet opening, a width of said first groove being different from a width of said second groove, and a lid member for closing said outlet opening, said lid member being slidably inserted into said first groove;

said outlet opening being capable of coupling to a funnel for removing said developer into a developer container, said funnel being slidably inserted into said second groove.

15. A copying machine as in claim 14, further including an inlet opening in said developer means for supplying new developer therethrough into said developing means, said inlet opening being capable of being coupled to said funnel for introducing said new developer.

16. A copying machine as in claim 15, wherein said inlet opening is provided with an inlet groove so as to allow said funnel to be slidably inserted into said inlet groove for coupling said funnel to said inlet opening.

17. A copying machine as in claim 14, wherein said developing means is connected to a guide means that is in turn slidably connected to a bar means that is in turn connected to said unit frame so as to allow said developing means to be slidably moved close to and separated from said photorecptor means.

* * * * *